US006747231B1

(12) United States Patent
Bretschneider et al.

(10) Patent No.: US 6,747,231 B1
(45) Date of Patent: Jun. 8, 2004

(54) SORTING DEVICE FOR FLAT MAIL ITEMS

(75) Inventors: Peter Bretschneider, Birkenwerder (DE); Rudolf Schuster, Kirchheim (DE)

(73) Assignee: Siemens AG, Munich (DE)

( * ) Notice: Subject to any disclaimer, the term of this patent is extended or adjusted under 35 U.S.C. 154(b) by 94 days.

(21) Appl. No.: 10/070,829

(22) PCT Filed: Jul. 19, 2000

(86) PCT No.: PCT/DE00/02352

§ 371 (c)(1),
(2), (4) Date: Mar. 11, 2002

(87) PCT Pub. No.: WO01/19536

PCT Pub. Date: Mar. 22, 2001

(30) Foreign Application Priority Data

Sep. 10, 1999 (DE) ..... 199 43 361

(51) Int. Cl.[7] ..... B07B 13/05; B65H 47/26

(52) U.S. Cl. ..... 209/584; 209/681; 209/912; 198/460.1

(58) Field of Search ..... 198/360, 460.1, 198/408; 209/584, 681, 698, 900, 912, 933, 934

(56) References Cited

U.S. PATENT DOCUMENTS 3,915,293 A * 10/1975 Melchiorre et al. ..... 198/408
4,008,813 A * 2/1977 Leersnijder ..... 414/265
4,131,192 A * 12/1978 Cipolla ..... 198/460.1
4,434,583 A * 3/1984 Burgess, Jr. ..... 451/242
4,619,576 A * 10/1986 George et al. ..... 414/300
4,645,062 A * 2/1987 Kopp ..... 198/448
4,895,242 A * 1/1990 Michel ..... 198/370.04
5,191,963 A * 3/1993 Delsanto ..... 198/429
5,193,964 A * 3/1993 Soros ..... 198/588

FOREIGN PATENT DOCUMENTS

| | | |
|---|---|---|
| CH | 267 002 | 2/1950 |
| EP | 0 608 161 | 7/1994 |
| EP | 0 820 818 | 1/1998 |
| FR | 2 619 092 | 2/1989 |
| JP | 59-1053317 | 7/1984 |
| WO | WO 97/10904 | 3/1997 |

* cited by examiner

*Primary Examiner*—Donald P. Walsh
*Assistant Examiner*—Joseph C. Rodriguez
(74) *Attorney, Agent, or Firm*—Jacob Eisenberg; Siemens AG

(57) ABSTRACT

A sorting arrangement for flat items of mail, has a plurality of containers (1) which circulate in a conveying loop with at least two semicircular conveying sections (2) and are intended for laterally receiving, for transporting and for discharging in a controllable manner in each case one item of mail standing on a narrow side, and a plurality of depositing receptacles (4) which are arranged along the conveying arrangement, beneath the containers (1), and are open at the top. The lateral openings of the containers (1), for loading purposes, are located in the interior of the conveying loop, and the transporting element (7) of the material infeed is arranged within the conveying loop, and transports the items of mail into the lateral openings of the containers (1) in a horizontally aligned semicircular conveying section.

11 Claims, 2 Drawing Sheets

SORTING DEVICE FOR FLAT MAIL ITEMS

BACKGROUND OF THE INVENTION

The present invention relates to a sorting arrangement according to the preamble of patent claim 1.

For sorting flat items of mail, such as letters, postcards, packets and the like, in accordance with the distribution information specified on their top surface, it is known for these items of mail to be received into special containers, transported and discharged in a controlled manner.

EP-A-0608161 thus discloses a sorting apparatus in which flat articles are transported laterally into containers from the outside by means of a channel-like, fixed-location feed apparatus. These containers, which circulate in a closed loop, are moved horizontally past the feed apparatus and by the specific opening of flaps, in accordance with the sorting instructions, the items of mail then drop into sorting containers located therebeneath. In order for the items of mail to be introduced reliably into the moving containers, either it is necessary for the items of mail to have a very high transporting speed in the feed apparatus, which may result in damage when the items of mail are braked in the container, or the speed of the containers is very low or the containers are at a standstill during the introduction operation, which means a reduction in the machine throughput.

In order to organize items in a certain order, EP 820 818 A1 has disclosed a solution which utilizes an intermediate store which comprises containers which circulate on a conveying arrangement in a conveying loop with at least two semicircular conveying sections, and can each receive an item of mail and, on command, discharge the same again into the actual depositing receptacle. In this case, initially all of the items of mail which are to be organized are accommodated in any desired sequence in the pockets of the intermediate store. Then, the items of mail are removed from the containers of the intermediate store, and transferred into the depositing receptacles, such that they are located in the latter in the order which is to be produced. The depositing receptacles, which are open at the top, are located along the rectilinear sections of the conveying arrangement beneath the containers.

In order to improve the introduction of the items of mail into the containers, the end section of the transporting means of the feed arrangement, according to WO 97/10904, has been configured pivotably such that, during the introduction of the respective item of mail, said end section is pivoted along in essentially the same direction, and at essentially the same speed, as the moving container, and is pivoted back again following the introduction operation.

If it is necessary or advantageous, during the respective sorting run, for items of mail to be loaded into empty circulating containers while other containers are still full, the feed operation has to be coordinated with the position of the empty containers, i.e., if a plurality of full containers are located between an empty container and the following empty container, the operation of feeding the items of mail is interrupted until such time as the full containers have moved past the introduction location. This stopping of the operation of feeding items of mail, however, results in an undesired loss in throughput.

A further important feature of sorting apparatuses is constituted by the dimensions thereof, which are to be as small as possible. In order to reduce the dimensions of corresponding sorting apparatuses, CH-A-267002 and JP-A 59053317 have thus described solutions in which the feed arrangement extends into the interior of the conveying loop and the articles are transported laterally into or onto the containers on the inside.

SUMMARY OF THE INVENTION

An object of the invention specified in claim 1 is thus to provide a sorting arrangement of the generic type which has at least one feed arrangement and containers which circulate in a conveying loop and are intended for laterally receiving, for transporting and for discharging in a controllable manner the items of mail to sorting depositing receptacles arranged along the conveying loop, and which has smaller dimesions and allows a higher throughput when items of mail are loaded into empty containers in a situation with already/or still full containers.

By virtue of the lateral openings of the containers, for loading purposes, being shifted, in relation to the prior art, into the interior of the conveying loop and the transporting means of the feed arrangement being arranged partially within the conveying loop such that the items of mail are transported into the lateral openings of the containers in a horizontally aligned, semicircular conveying section, it being possible for the end section of the transporting means to be pivoted about the center point of the semicircular conveying section, there is a reduction in the required dimensions of the sorting arrangement and, during pivoting of the end section of the transporting means, on account of the semicircular container arrangement, there is no need for any length compensation.

Advantageous configurations of the invention are illustrated in the subclaims.

It is thus advantageous, in addition to the known pivoting for the introduction of the items of mail into the containers, for the end section of the transporting means to be pivoted such that the item of mail which is currently to be introduced can be loaded into an empty container, without delay, within a defined pivoting region. If a plurality of full containers are thus located between the container which has just been loaded and the container which is next to be loaded, then there is no need for the item-of-mail feed speed to be reduced, or even stopped, in each case until the empty container has reached the introduction location, which up until now has always be in the same location; rather, the end location of the transporting means can be pivoted to such an extent counter to the transporting direction at such a speed that the next item of mail is introduced into the next circulating empty container with the item-of-mail feed speed maintained. Relatively high losses in throughput are avoided in this way. Once the end section has reached the end of the pivoting region, counter to the transporting direction, it obviously has to be pivoted back to the start.

In a further advantageous configuration, the containers are inclined in the transporting direction, in order that the items of mail have a defined position in the container and slide reliably into the depositing receptacles. For this purpose, the orientation of the end of the transporting stretch (introduction location) more or less corresponds to this inclination. A vertical orientation is present at the pivoting point of the transporting means, in order to allow a straightforward pivoting mechanism.

In order to ensure an unobstructed feed of items of mail and good accessibility, it is advantageous for the separating arrangement of the feed arrangement to be arranged outside the conveying loop and beneath the container plane. The transporting means then leads in an upwardly sloping manner into the interior of the conveying loop such that it terminates level with the containers.

It is also favorable for the transporting means to be configured as a sandwich belt system in which the items of mail are retained, and transported, in a state in which they are clamped in between elastic belts, as a result of which the level of gap shifting can be kept low. In order to keep the differences in length of the returning belts to a low level during pivoting, these are guided past the pivoting point as closely as possible to the same.

In a further configuration, the depositing receptacles are subdivided into two more or less equally sized groups, it being the case that, in sorting runs proceeding one after the other, the items of mail are alternately sorted only into one of the two groups. This makes it possible for the machine to be loaded and unloaded by one person without the sorting procedure being stopped.

If the items of mail are advantageously loaded into empty containers even when items of mail of the previous sorting run are still located in containers, the throughput increases.

In a space-saving development of the invention, the reading arrangement and, if required, further subassemblies, such as measuring arrangements and printers, are arranged along the fixed part of the transporting means.

BRIEF DESCRIPTION OF THE SEVERAL VIEWS OF THE DRAWINGS

An exemplary embodiment of the invention is explained in more detail hereinbelow with reference to the drawing.

In the drawing.

DETAILED DESCRIPTION OF THE INVENTION

Figure 1A:
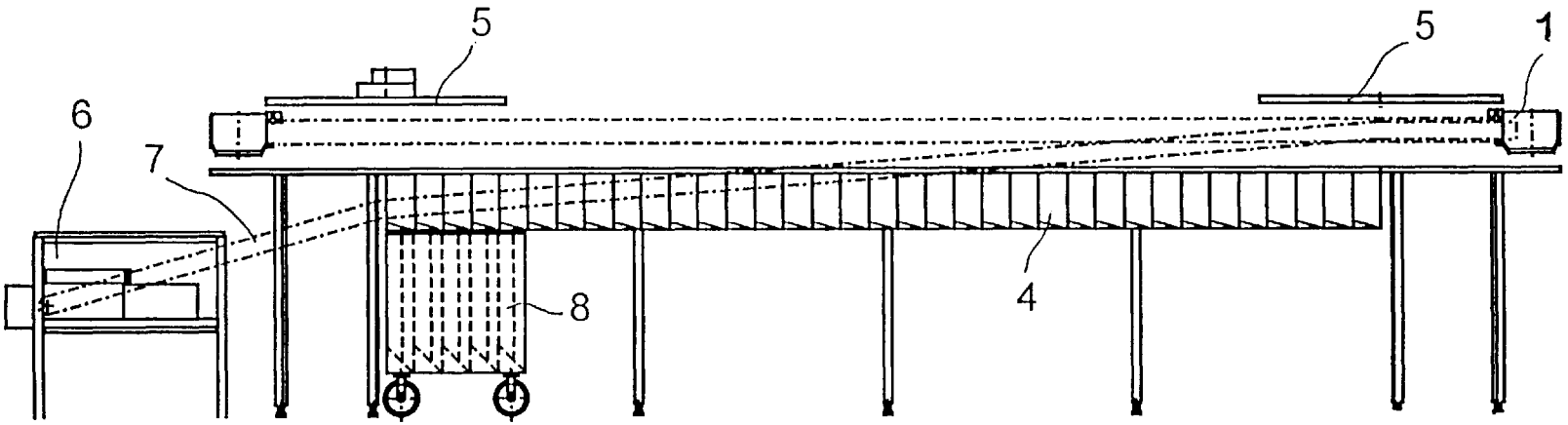
FIG. 1*a* shows a schematic side view of the sorting arrangement.
Figure 1B:
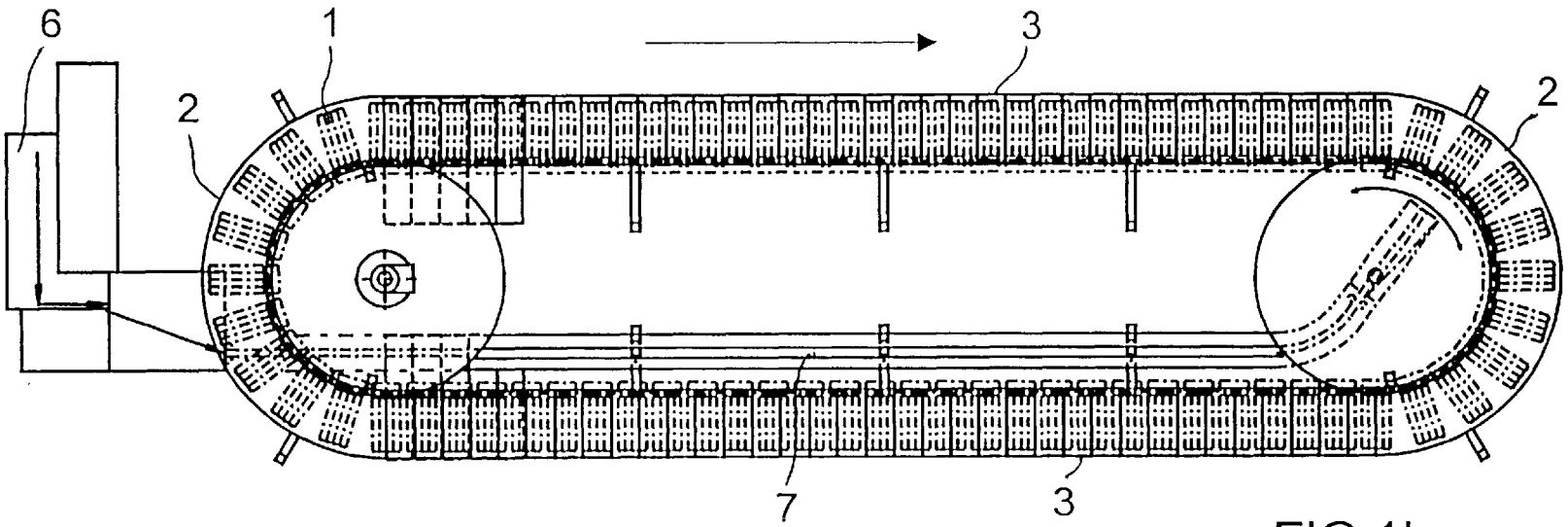
FIG. 1*b* shows a schematic plan view of the sorting arrangement.

The sorting arrangement illustrated in FIGS. 1*a* and *b* constitutes a conveying arrangement with circulating containers 1 for in each case one flat item of mail standing on its narrow side. These containers 1, which are lined up in a row one beside the other, circulate in the arrow direction in a horizontally aligned conveying loop with two semicircular conveying sections 2 and two rectilinearly running sections 3 therebetween. Located beneath the two rectilinearly running conveying sections 3 are depositing receptacles 4 which are open at the top and into which the items of mail are sorted in accordance with the current sorting plan The containers 1 are combined in units of four containers 1 in each case. If a certain item of mail is to be transported into a certain depositing receptacle 4, then, by means of a loading mechanism of this depositing receptacle 4, said mechanism not being illustrated but being known per se, the container above the depositing receptacle is opened, and the item of mail slides into the depositing receptacle 4. In order that his operation of sliding into the depositing receptacle proceeds in a defined manner, the containers 1 are inclined in to transporting direction, with the result that the bottom parts are located behind the top parts, as seen in the transporting direction. When the container 1 is opened, the item of mail slides downward, in the container orientation, into the depositing receptacle 4, in which the item of mail then correspondingly stands obliquely on a narrow side and leans against a corresponding side wall. This avoids the situation, in particular in the case of empty depositing receptacles 4, where the items of mail tilt to the other side and ordered stacking becomes impossible. The semicircular conveying sections 2 are guided on turntables 5. If it is necessary to process a large number of items of mail in one sorting run, it is, of course, also possible to increase the number of containers 1 in a loop, while maintaining the same surface area, by the circulation taking place on two levels, with the depositing receptacles 4 being maintained. In order to achieve the highest possible throughput, overlapping processing takes place, i e. before the operation of items of mail which are located in the containers 1 being transported into the depositing receptacles 4 has been completed, items of mail for a new sorting run (different address area) are loaded into the containers 1 which have been emptied in the meantime. Either the depositing receptacles 4 are assigned to certain address/address areas or the items of mail are sorted into the depositing receptacles 4 in defined sequences of stopping points. If the depositing receptacles 4 are subdivided into two groups (each depositing-receptacle row corresponds to one group) and, for the sorting runs carried out one after the other, sorting is carried out alternately only into one of the two depositing-receptacle groups, even in the case of overlapping operation. In the case of overlapping operation, it is possible for a plurality of still full containers 1 to be located between two empty containers 1. In order to avoid the feed of items of mail having to be slowed down or stopped until the empty container 1 is located in front of a fixed introduction location, it has to be possible for the end section of the transporting means 7 of the material in feeds to be pivoted, counter to the transporting direction of the containers 1, in a defined region, which is as large as possible, to the next empty container at such a speed that the item of mail which is to be introduced does not have to be stopped. Once the end section has arrived at the end of the pivoting region, it has to be pivoted back into the pivoting region.

This pivoting operation is combined with the pivoting for assisting the introduction of the items of mail (concomitant pivoting during the introduction more or less at the transporting speed of the containers). Since the two pivoting movements run in opposite directions, rearward pivoting movements are only necessary when the end section of the transporting means 7 has reached the limits of the pivoting region. In order for the pivoting operation to be executed with the lowest possible outlay and, at the same time, for the surface area of the sorting arrangement to be reduced, the containers 1 are loaded from the inside, i.e. the loading openings of the containers 1 are directed to the inside. The items of mail are separated from a stack in a separating arrangement 6 of the feed arrangement and then conveyed, by means of a sandwich belt system as transporting means 7, to the semicircular conveying section 2 remote from the separating arrangement 6. The subassemblies which are not illustrated, such as a reading arrangement, sensors which pick up the items of mail and printers, are arranged along the sandwich belt system. The separating arrangement 6 is located outside and beneath the circulating containers 1, with the result that the stacks of mail which are to be separated and sorted can be fed conveniently. The items of mail are transported through beneath the semicircular conveying section 2 on this side, into the interior of the conveying loop, until they reach the other semicircular conveying section 2 level with the containers 1. Located beneath the depositing receptacles 4 is an emptying carriage, in which the operator positions the sorted items of mail in an ordered manner. He/she removes the items of mail from the laterally opened depositing receptacles for this purpose.

Figure 2:
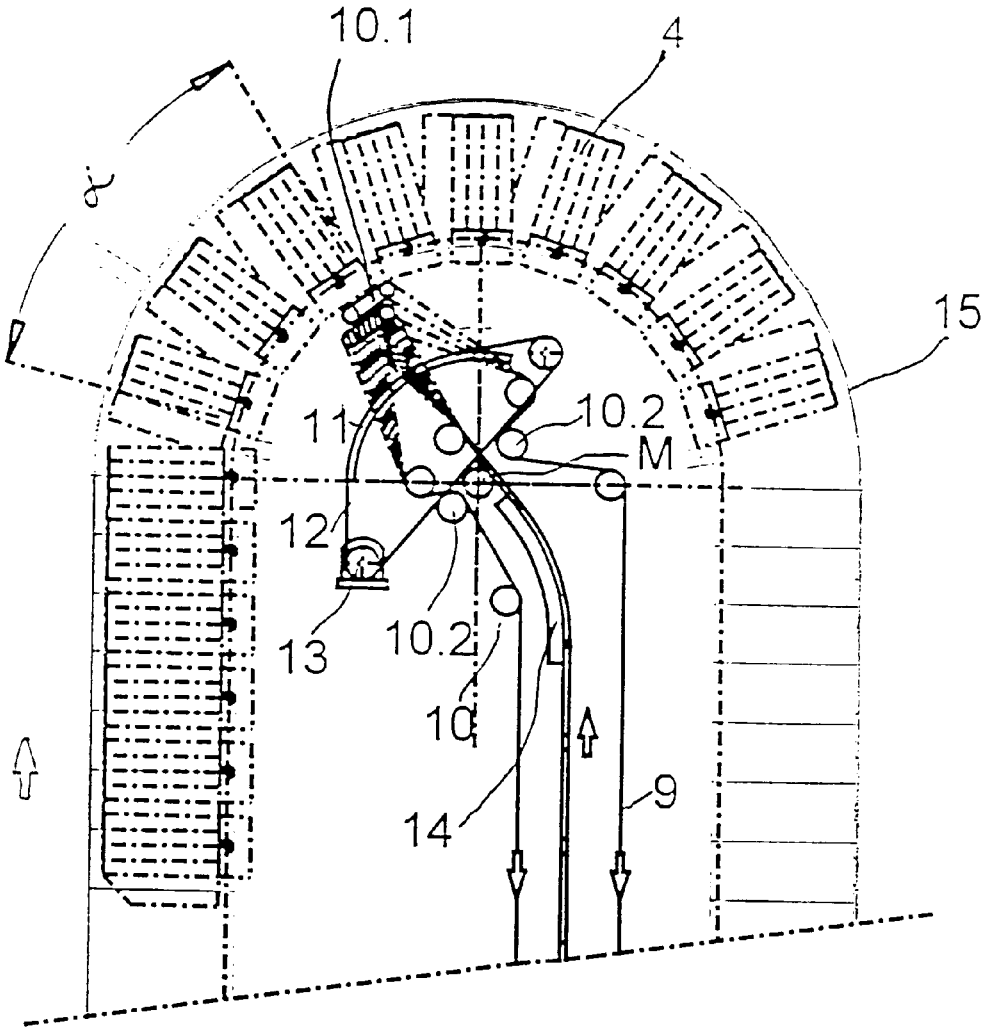
FIG. 2 shows a plan view of the loading region.

The loading region, i.e. the end section of the sandwich belt system, and the semicircular conveying section 2 are explained in more detail in FIG. 2. The end section of the sandwich belt system, comprising sandwich belts 9, guide and drive rollers 10 and a slide guide 14, can be pivoted about the center point M of the conveying section 2. A slide guide 14 with a relatively large radius of curvature has been selected instead of a roller of small diameter, in order for the loading to which the items of mail are subjected during deflection to be kept as low as possible. The pivoting region, with the pivoting angle a, is located on the left-hand side, with the result that sufficient tensioning is produced between the sandwich belts 9 for clamping the items of mail firmly solely by virtue of the sandwich belts 9 being guided over the arcuate slide guide 14 with smooth surface, e.g. Teflon. The sandwich belts 9 are guided back, over guide rollers 10.2, as closely as possible to the deflecting and center point M, with the result that there are only small changes in length during the pivoting operation and it is possible to compensate for these via the elasticity of the sandwich belts 9.

The two end rollers 10.1, forming the introduction location, are inclined in adaptation to the containers 4, in order to ensure the introduction of the items of mail into the narrow side openings. The end section is pivoted by means of a toothed belt 12 which is driven by a motor 13 and is guided over an arcuate guide 11, which can be pivoted in the center point M, of the end section with a corresponding toothing formation. The large transmission ratio results in high accelerations being possible during start-up and stopping. Safety coverings 15 are located on the outsides of the containers in the semicircular conveying sections 2. The containers 4 may be driven both by a cable and by a chain.

What is claimed is:

1. A sorting arrangement for flat items of mail, having at least one feed arrangement, comprising:

separating arrangement and a transporting means for the separated items of mail, a reading arrangement for determining distribution information located on the separated items of mail, a plurality of containers which circulate on at least one conveying arrangement in a conveying loop with at least two semicircular conveying sections, of which at least one is aligned horizontally, and are intended for laterally receiving, for transporting and for discharging in a controllable manner in each case one item of mail standing on a narrow side, a plurality of depositing receptacles which are arranged along the conveying arrangement, beneath the containers, are open at the top and receive the items of mail from the containers, a control arrangement which, also in accordance with the distribution information read, controls the discharge of the items of mail from the containers to the depositing receptacles such that each item of mail located in a container is discharged to the depositing receptacle assigned to this distribution information, if required in a predetermined sequence, and wherein the end section of the transporting means of the feed arrangement can be pivoted about the center point (M) of the semicircular, horizontally aligned conveying section and, during the introduction of the respective item of mail into an empty moving container, is pivoted in essentially the same direction as the moving containers and at a speed adapted to the container speed, and in that, for loading purposes, the lateral openings of the containers are located in the interior of the conveying loop, and the transporting means of the feed arrangement is arranged partially within the conveying loop, and transports the items of mail into the lateral openings of the containers in the horizontally aligned semicircular conveying section.

2. The sorting arrangement as claimed in claim 1, wherein in addition to pivoting for the introduction operation, the end section of the transporting means can be pivoted such that, the point in time at which the item of mail which is currently to be introduced has reached the end of the transporting stretch without delay, the pivotably end is located within a defined pivoting region in the empty container.

3. The sorting arrangement as claimed in claim 1, the containers are inclined in the transporting direction, the items of mail are aligned vertically at the pivoting point (M) of the transporting means, and the orientation of the items of mail substantially corresponds to the orientation of the containers at the end of the transporting means.

4. The sorting arrangement as claimed in claim 1, wherein the separating arrangement is located outside the conveying loop and beneath the container plane, and the transporting means is guided in an upwardly sloping manner into the interior of the conveying loop such that it terminates level with the containers.

5. The sorting arrangement as claimed in claim 1, wherein the transporting means is configured as a sandwich belt system, and rollers which guide returning belts are arranged as closely as possible to the pivoting point (M).

6. The sorting arrangement as claimed in claim 1, wherein the depositing receptacles are subdivided into two more or less equally sized groups and, in the case of sorting runs proceeding one after the other, the items of mail for different address areas are alternately sorted only into one of the two depositing-receptacle groups.

7. The sorting arrangement as claimed in claim 6, wherein the items of mail for the current address area can be loaded into empty circulating containers even when items of mail for the preceding address area are still located in containers.

8. The sorting arrangement as claimed in claim 1, wherein the reading arrangement and, if required, further subassemblies, the subassemblies comprising measuring arrangements and printers, are arranged along a fixed part of the transporting means of the feed arrangement.

9. The sorting arrangement as claimed in claim 2, wherein the containers are inclined in the transporting direction, the items of mail are aligned vertically at the pivoting point (M) of the transporting means, and the orientation of the items of mail more or less corresponds to the orientation of the containers at the end of the transporting means.

10. The sorting arrangement as claimed in claim 9, wherein the separating arrangement is located outside the conveying loop and beneath the container plane, and the transporting means is guided in an upwardly sloping manner into the interior of the conveying loop such that it terminates level with the containers.

11. The sorting arrangement as claimed in claim 10, wherein the transporting means is configured as a sandwich belt system, and rollers which guide returning belts are arranged as closely as possible to the pivoting point (M).

* * * * *